US009297218B2

(12) United States Patent
Jordan et al.

(10) Patent No.: US 9,297,218 B2
(45) **Date of Patent: *Mar. 29, 2016**

(54) WELL CENTRALIZER

(71) Applicant: BLACKHAWK SPECIALTY TOOLS, LLC, Houston, TX (US)

(72) Inventors: J. Christopher Jordan, Houston, TX (US); James G. Martens, Houston, TX (US); Jeffrey J. Arcement, Houma, LA (US); Juan Carlos E. Mondelli, Houston, TX (US); John E. Hebert, Houma, LA (US); Scottie J. Scott, Houma, LA (US); Thomas A. Dupre', Houma, LA (US)

(73) Assignee: Blackhawk Specialty Tools, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/822,173

(22) Filed: Aug. 10, 2015

(65) Prior Publication Data

US 2015/0368991 A1 Dec. 24, 2015

Related U.S. Application Data

(63) Continuation of application No. 13/847,729, filed on Mar. 20, 2013, now Pat. No. 9,127,519.

(51) Int. Cl.
*E21B 19/24* (2006.01)
*E21B 17/10* (2006.01)

(52) U.S. Cl.
CPC ..... *E21B 17/1078* (2013.01); *E21B 17/1028* (2013.01); *E21B 19/24* (2013.01); *Y10T 29/49826* (2015.01)

(58) Field of Classification Search
CPC ..... E21B 17/1028; E21B 17/1078; E21B 17/1021; E21B 19/24; Y10T 29/49826
See application file for complete search history.

(56) References Cited

U.S. PATENT DOCUMENTS 1,775,376 A * 9/1930 Steps ..... E21B 17/1028 166/241.6
2,058,310 A * 10/1936 Hartman ..... E21B 17/1028 166/241.6
2,089,553 A * 8/1937 Hartman ..... E21B 17/1028 166/241.6
2,249,333 A * 7/1941 Smith ..... C10G 27/04 252/401
2,618,342 A * 11/1952 Meyer ..... E21B 34/12 166/138
4,042,022 A * 8/1977 Wills ..... E21B 17/1028 166/241.7
4,651,823 A * 3/1987 Spikes ..... E21B 17/1028 166/241.7
4,794,986 A * 1/1989 Langer ..... E21B 17/1028 166/241.7
H001192 H * 6/1993 Keller ..... E21B 17/1028 166/241.6
5,238,062 A * 8/1993 Reinholdt ..... E21B 17/1028 166/241.7
5,261,488 A * 11/1993 Gullet ..... E21B 17/1028 166/241.7
5,575,333 A * 11/1996 Lirette ..... E21B 17/1028 166/241.1
6,209,638 B1 * 4/2001 Mikolajczyk ..... E21B 17/1028 166/241.1

(Continued)

*Primary Examiner* — Daniel P Stephenson
(74) *Attorney, Agent, or Firm* — Ted M. Anthony

(57) ABSTRACT

A centralizer assembly having a tubular body member with upper and lower channels extending around the external surface of said central tubular body member. A bow spring assembly having bow spring members is installed around the outer surface of the tubular body member and can rotate about the outer surface of the central tubular body member. Bow spring heel supports prevent the bow spring members from contacting the outer surface of the central tubular member when compressed. Non-abrasive materials prevent damage to wellhead or other polished bore receptacles. A robust bolster frame protects the centralizer assembly during shipping, storage or other periods of non-use.

16 Claims, 11 Drawing Sheets

(56) References Cited

U.S. PATENT DOCUMENTS 6,453,998 B1 * 9/2002 Reeve ..... E21B 17/1014 166/241.1
D671,960 S * 12/2012 Kirk ..... E21B 17/1028 D15/21
8,701,783 B2 * 4/2014 Buytaert ..... E21B 17/1028 166/213
8,833,446 B2 * 9/2014 Lively ..... E21B 17/1028 166/213
8,991,487 B2 * 3/2015 Levie ..... E21B 17/1028 166/241.1
9,038,738 B2 * 5/2015 Levie ..... E21B 17/1028 166/381
9,127,519 B2 * 9/2015 Jordan ..... E21B 19/24
2003/0070803 A1 * 4/2003 Gremillion ..... E21B 17/1078 166/241.6
2011/0030973 A1 * 2/2011 Jenner ..... E21B 37/02 166/382
2011/0186289 A1 * 8/2011 Buytaert ..... E21B 17/10 166/241.6
2015/0047855 A1 * 2/2015 Buytaert ..... E21B 17/1028 166/378

* cited by examiner

WELL CENTRALIZER

BACKGROUND OF THE INVENTION

1. Field of the Invention

The present invention pertains to bow-type centralizers used during operations in oil and/or gas wells. More particularly, the present invention pertains to bow-type centralizers used on casing strings or other tubular goods run into said wells.

2. Brief Description of the Prior Art

Drilling of an oil or gas well is frequently accomplished using a surface drilling rig and tubular drill pipe. When installing drill pipe (or other tubular goods) into a well, such pipe is typically inserted into a wellbore in a number of sections of roughly equal length commonly referred to as "joints". As a well penetrates deeper into the earth, additional joints of pipe must be added to the ever lengthening "drill string" at the drilling rig in order to increase the depth of the well.

After a well is drilled to a desired depth, relatively large diameter pipe known as casing is typically installed within a well and then cemented in place. As casing is installed in a well, it is frequently beneficial to rotate and/or reciprocate such casing within said well. After the casing is installed, cementing is performed by pumping a predetermined volume of cement slurry into the well using high-pressure pumps. The cement slurry is typically pumped down the inner bore of the casing, out the distal end of the casing, and around the outer surface of the casing.

After a predetermined volume of cement is pumped, a plug or wiper assembly is typically pumped down the inner bore of the casing using drilling mud or other fluid in order to fully displace the cement from the inner bore of the casing. In this manner, cement slurry leaves the inner bore of the casing and enters the annular space existing between the outer surface of the casing and the inner surface of the wellbore. After such cement becomes hard, it should beneficially secure the casing in place and form a fluid seal to prevent fluid flow along the outer surface of the casing.

In many conventional cementing operations, an apparatus known as a float collar or float assembly is frequently utilized at or near the bottom (distal) end of the casing string. In most cases, the float assembly comprises a short length of casing or other tubular housing equipped with a check valve assembly. Such check-valve assembly permits the cement slurry to flow out the distal end of the casing, but prevents back-flow of the heavier cement slurry into the inner bore of the casing when pumping stops.

Devices known as "centralizers" are also frequently used in connection with the installation and cementing of casing in wells. Such centralizers are often mounted on casing strings in order to center such casing strings in a well and obtain a uniformly thick cement sheath around the outer surface of the casing. Different types of centralizers have been used, and casing centralization is generally well known to those having skill in the art. Centralization of a casing string near its bottom end, in particular around the float equipment, is frequently considered especially important to securing a uniform cement sheath and, consequently, a fluid seal around the bottom (distal) end of a casing string. For that reason, placement of centralizers at or near float equipment and/or the distal end of a casing string is often desirable.

One common type of centralizer is a "bow spring" centralizer. Such bow spring centralizers typically comprise a pair of spaced-apart end bands which encircle a casing string (or other central tubular member that can be installed within the length of a casing string), and are held in place at a desired location on the casing. A number of outwardly bowed, resilient bow spring blade members connect the two end bands, spaced at desired locations around the circumference of said bands. The configuration of bow spring centralizers permits the bow spring blades to at least partially collapse as a casing string is run into a borehole and passes through any diameter restriction, such as a piece of equipment or wellbore section having an inner diameter smaller than the extended bow spring diameter. Such bow springs can then extend back radially outward after passage of said centralizer through said reduced diameter section.

Unlike conventional land or platform-based drilling operations, when drilling is conducted from drill ship rigs, semi-submersible rigs and certain jack-up rigs, subsea blowout preventer and wellhead assemblies are located on or in the vicinity of the sea floor. Typically, a large diameter pipe known as a riser is used as a conduit to connect the subsea assemblies to such rig. During drilling operations, drill pipe and other downhole equipment are lowered from a rig through such riser, as well as through the subsea blowout preventer assembly and wellhead, and into the hole which is being drilled into the earth's crust.

When a casing string is installed in such a well, the upper or proximate end of such casing string is typically seated or installed within a subsea wellhead assembly. In such cases, it is generally advantageous that a fluid pressure seal be formed between the casing string and the wellhead assembly. In order to facilitate such a seal, certain internal surface(s) of the subsea wellhead often include at least one polished bore receptacle or elastomer/composite sealing element which is designed to receive and form a fluid pressure seal with the casing string. As a result, the internal sealing surface of the wellhead assembly, and particularly such polished bore receptacle(s) and/or sealing elements, must be clean and relatively free from wear so that a casing string can be properly seated and sealed within the wellhead.

The running of pipe (drill string, casing and/or other equipment) through a wellhead can cause wear on the internal surface of a wellhead, thereby damaging the inner sealing profile of said wellhead and making it difficult for casing to be properly received within said wellhead. This is especially true for items having a larger outer diameter than other pipe or tubular goods passing through a wellhead (such as, for example centralizers), as such larger items have a tendency to gouge, mar, scar and/or scratch polished surfaces or sealing areas of said wellhead.

In certain circumstances, it is beneficial for components of a centralizer assembly (that is, end bands and bow springs) and said central body member to be capable of rotating relative to one another. In other words, in certain circumstances (particularly when a casing string is being rotated) it is beneficial for said body member to rotate within said centralizer assembly. However, when conventional centralizer bow springs are compressed—such as during passage of a centralizer assembly through restrictions in a well or other equipment—said bow springs can come in contact with and "pinch" against the outer surface of said central tubular member. Such contact generates frictional resistance forces that prevent a central tubular member from freely rotating within such centralizer components (end bands and bow springs). Conventional rotating centralizer designs cause high rotating torques due to such frictional resistance forces encountered during pipe rotation operations.

Thus, there is a need for a bow-spring type centralizer assembly with improved rotating capability creating less frictional resistance during rotation. Said bow-spring centralizer assembly should exhibit superior strength characteristics, while minimizing damage to wellheads, polished bores or other downhole equipment.

SUMMARY OF THE INVENTION

The centralizer assembly of the present invention generally comprises a tubular body member having a central flow bore extending therethrough. Upper and lower recesses or channels extend around the external surface of said central tubular body. In the preferred embodiment, said upper and lower channels are oriented substantially parallel to each other, and substantially perpendicular to the central flow bore of said tubular body. Moreover, said upper and lower channels extend around substantially the entire circumference of said tubular body.

A bow spring assembly is disposed around the outer surface of said tubular body member. Specifically, a substantially cylindrical upper end band is disposed within said upper channel and extends around the outer circumference of the tubular body, while a generally cylindrical lower end band is disposed within said lower channel and also extends around the outer circumference of the tubular body.

A plurality of bow spring members having predetermined radial spacing extends between the upper and lower end bands. In the preferred embodiment, a notched design of said end bands provide for stronger bond with flush profile, with chamfers on end band notches for flush profile welding. Said bow spring members extend radially outward from said tubular body member and bias said upper and lower end bands toward each other. When compressed inward, said bow spring members collapse toward said tubular body member, and bias said upper and lower end bands away from each other.

Said bow spring assembly and said central tubular body member are beneficially rotatable relative to one another. In one preferred embodiment, the present invention includes a bow spring heel support journal to prevent such bow spring members from contacting the outer surface of said central tubular member when said bow springs are compressed, such as in a wellbore restriction, even when said central tubular body is rotated within said bow spring assembly. Further, said journal also provides a centralizer stop (that is, the stop ring portion of the end band prevents the centralizer from sliding off the central tubular member and allows it to be pulled in rather than pushed into a restriction).

Said bow spring heel support effectively eliminates contact between inwardly-compressed bow spring members and the outer surface of the central tubular member (particularly near the heels of the bow springs), as well as any torque forces and/or frictional resistance that said centralizer bow springs may create as the central tubular member rotates relative to said bow spring members and end bands. Put another way, when said bow spring members are fully elongated (such as when collapsed inward), said heel supports prevent said bow spring members from contacting the outer surface of said central tubular member.

Further, rotational interference can be further reduced by employing friction reducing means to assist or improve rotation of said central tubular member relative to said bow spring centralizer assembly. By way of illustration, but not limitation, such friction reducing means can include bearings (including, but not necessarily limited to, fluid bearings, roller bearings, ball bearings or needle bearings). Said bearings can be mounted on said central tubular body, centralizer end bands, or both. Additionally, the areas where said centralizer end bands contact said central tubular member can be constructed of, or coated with, friction reducing material including, without limitation, silicone or material(s) having high lubricity or wear resistance characteristics. Optional lubrication ports can be provided through said end bands to inject grease or other lubricant(s) to lubricate contact surfaces between said central tubular body and said centralizer end bands.

In order to reduce and/or prevent damage to wellheads and, more particularly, polished surfaces of such wellheads, components of the present material can be comprised of synthetic or composite materials (that is, non-abrasive and/or low friction materials) that will not damage, gouge or mar polished surfaces of wellheads or other equipment. In most cases, such components include bow spring members, because such bow spring members extend radially outward the greatest distance (that is, exhibit the greatest outer diameter) relative to the central body of the centralizer, and would likely have the most contact with such polished surfaces.

Certain components of the present invention (including, without limitation, central tubular body, end bands or bow spring elements) can be substantially or wholly comprised of synthetic, composite or other non-metallic material. Alternatively, certain components can be constructed with a metallic center for strength, with the edges or outer surfaces constructed of or coated with a plastic, composite, synthetic and/or other non-abrasive or low friction material having desired characteristics to prevent marring or scarring of a wellhead or other polished surfaces contacted by the centralizer of the present invention. By way of illustration, but not limitation, such non-abrasive or low friction material(s) can comprise elastomeric polyurethane, polytetrafluoroethylene (marketed under the Teflon® mark) and/or other materials exhibiting desired characteristics.

In the preferred embodiment, said non-abrasive or low friction material(s) can be sprayed or otherwise applied onto desired surface(s) of the centralizer or components thereof, in much the same way that truck bed liner materials (such as, for example, truck bed liners marketed under the trademark "Rhino Liners"®) are applied. Further, in circumstances when a centralizer of the present invention is removed from a well, such non-abrasive or low friction material can be applied (or re-applied) to such centralizer or portions thereof prior to running said centralizer back into the well.

In addition, the present invention includes an optional protective bolster assembly. The bolster assembly of the present invention can be used to protect the centralizer of present invention, and particularly the bow spring members thereof, from damage during transportation and/or handling of said centralizer assembly. In the preferred embodiment, the protective bolster assembly of the present invention is inexpensive, reusable and easy to install and remove. Further, said bolster assembly of the present invention can be beneficially constructed from composite material(s) to resist moisture absorption and prevent corrosion when in contact with metal components of a bow spring assembly or central tubular member. Additionally, such bolster assembly of the present invention can be beneficially collapsible for convenient storage and shipping of such bolster assembly when not in use or installed on a centralizer or other tool.

The bolster assembly of the present invention can be secured to centralizers or other tools using a variety of means. In the preferred embodiment, said bolster assembly can be beneficially secured to a centralizer using at least one elastic band in order to hold bows and bolster members safely in place. Thereafter, more robust bands or straps can be installed around said bolster members to secure said bolster members in place.

In an alternative embodiment, the bolster assembly of the present invention has rigid end pieces which can be molded or otherwise fabricated. This embodiment of the bolster assembly of the present invention, which can be utilized instead of conventional wooden crates or other similar devices commonly used for during the transportation and handling of such equipment, eliminates the need for securing bolster members in such crates.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
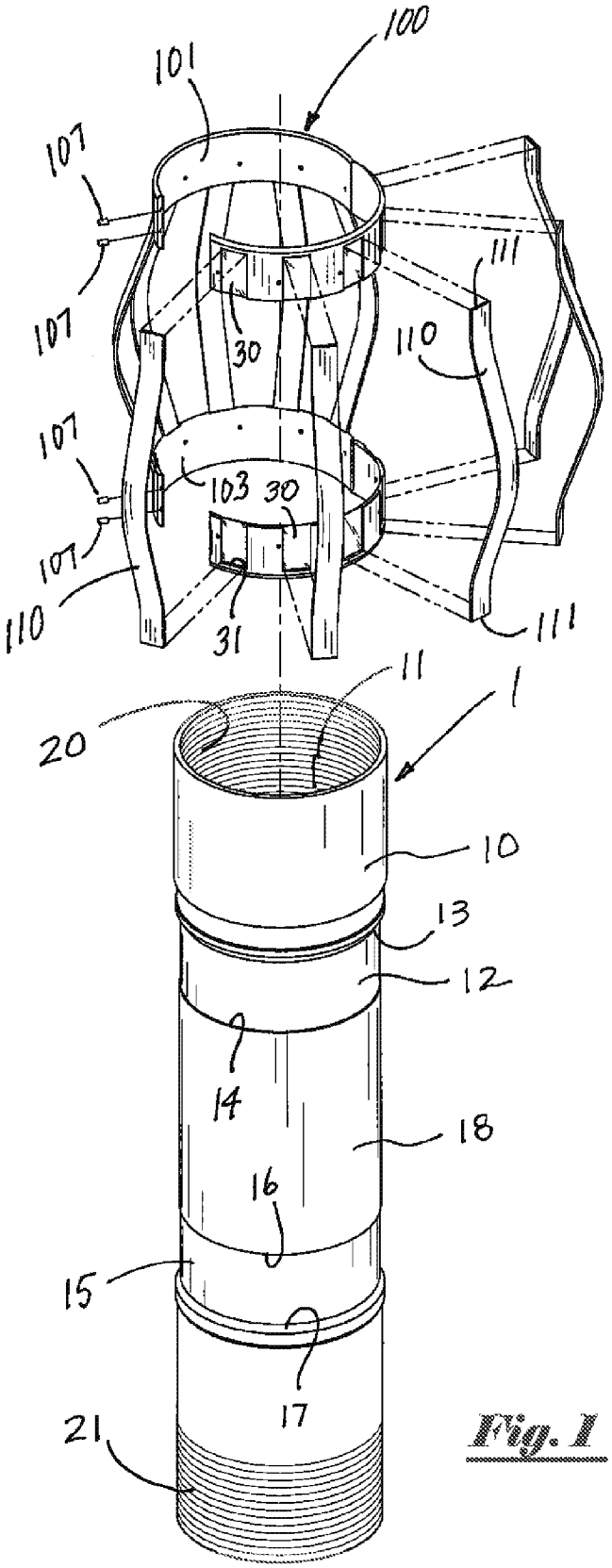
FIG. 1 depicts a partially exploded perspective view of a centralizer assembly of the present invention.

Referring to the drawings, FIG. 1 depicts a partially exploded perspective view of a centralizer assembly 1 of the present invention. Centralizer assembly 1 of the present invention generally comprises a central tubular body member 10 having a central flow bore 11 extending therethrough. Upper channel 12 and lower channel 15 each extend around the external surface of said central tubular body member 10. Said upper channel 12 and lower channel 15 are oriented substantially parallel to each other, substantially perpendicular to the longitudinal axis of central flow bore 11 of said tubular body member 10, and substantially around the entire outer circumference of said tubular body member 10.

Central body member 10 has upper threaded connection 20 and lower threaded connection 21. In the preferred embodiment, said lower threaded connection 21 is a male pin-end threaded connection, while upper threaded connection 20 is a female box-end threaded connection; said connections 20 and 21 are beneficially designed to mate with threaded connections of casing or other tubular goods to be equipped with centralizer assembly 1 of the present invention. By way of illustration, multiple centralizer assemblies 1 can be incorporated at desired location(s) along a string of casing being installed within a well.

Still referring to FIG. 1, bow spring assembly 100 is disposed around the outer surface of said tubular body member 10. Specifically, substantially cylindrical upper end band 101 is disposed within upper channel 12 of said central tubular body member 10, and extends around the outer circumference of said tubular body member 10. Similarly, substantially cylindrical lower end band 103 is disposed within lower channel 15 of tubular body member 10 and also extends around the outer circumference of said tubular body member 10.

A plurality of bow spring members 110 having predetermined spacing extends between said upper end band 101 and said lower end band 103. In the preferred embodiment, upper end band 101 and lower end band 103 are beneficially manufactured using a machining process (for example, wherein a piece of raw material is cut into a desired final shape and size by a controlled material-removal process), whereas other conventional centralizer end bands are commonly manufactured from rolled flat steel members. Said machined upper and lower end bands provide for more precise tolerances than conventional rolled steel end bands. Further, said upper end band 101 and lower end band 103 are "butterfly" split or spread apart in order to fit around the outer surface of tubular body member 10, and then rejoined together. Alignment pegs 107 can be used in order to assure proper alignment during such rejoining process.

In the preferred embodiment, a plurality of recesses 30 are notched or otherwise formed in upper end band 101 and lower end band 103. Further, said recesses 30 have chamfered edge surfaces 31. Said notched recesses 30 of said upper and lower end bands, which have chamfered edge surfaces 31 and receive ends 111 of bow spring members 110, permit flush profile welding (for example, "MIG" or "TIG" welding, or other joining method) and provide for a stronger welded bond having a flush profile.

Such flush profile is significant and highly desirable, because conventional methods of joining bow springs to an end band (such as, for example, bands and notches having abutting, squared-off edges) can result in weld beads forming on butt joints. Such weld beads can protrude radially outward from the outer surface of an end band (such as end bands 101 and 103), forming an unwanted protrusion that can damage wellheads or other equipment contacted by said centralizer assembly.

Frequently, the largest outer diameter of conventional centralizer assemblies occurs where said bow springs are welded to end bands. The flush-profile welding of the present invention ensures that no weld bead extends beyond the outer diameter of said end bands.

Figure 2:
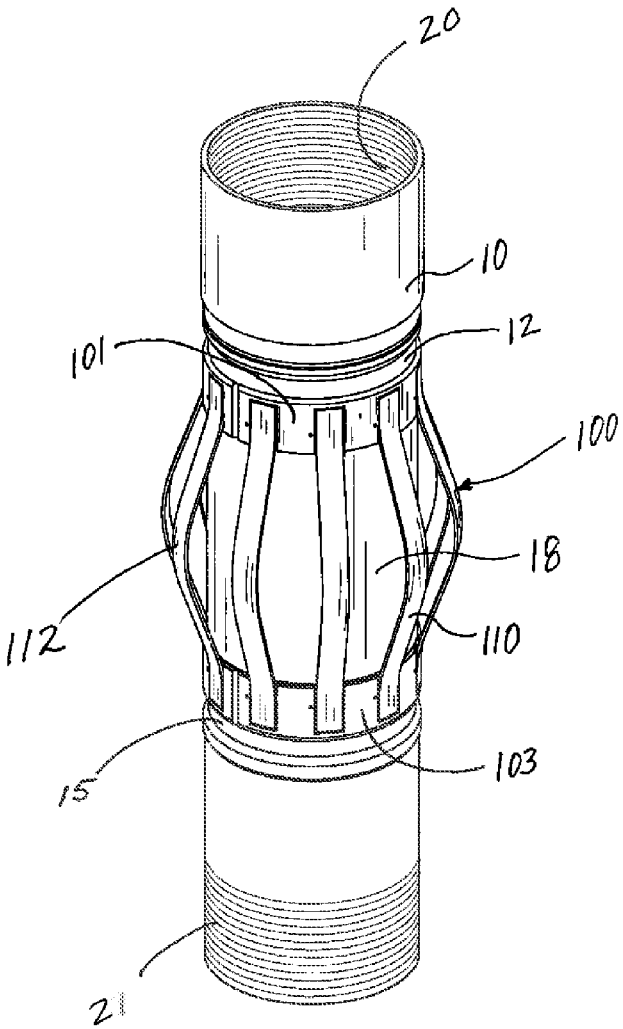
FIG. 2 depicts a perspective view of a centralizer assembly of the present invention with bow spring members extended.

FIG. 2 depicts a perspective view of a centralizer assembly 1 of the present invention with bow spring assembly 100 installed on central tubular body member 10. Bow spring members 110 extend radially outward from central tubular body member 10. As depicted in FIG. 2, bow spring members 110 are extended, biasing upper end band 101 (which moves axially within upper channel 12 of central body member 10) and lower end band 103 (which moves axially within lower channel 15 of central body member 10) generally toward each other. As depicted in FIG. 2, said bow spring members 110 extend radially outward from central body member 10, creating a larger overall outer diameter for centralizer assembly 1.

Figure 3:
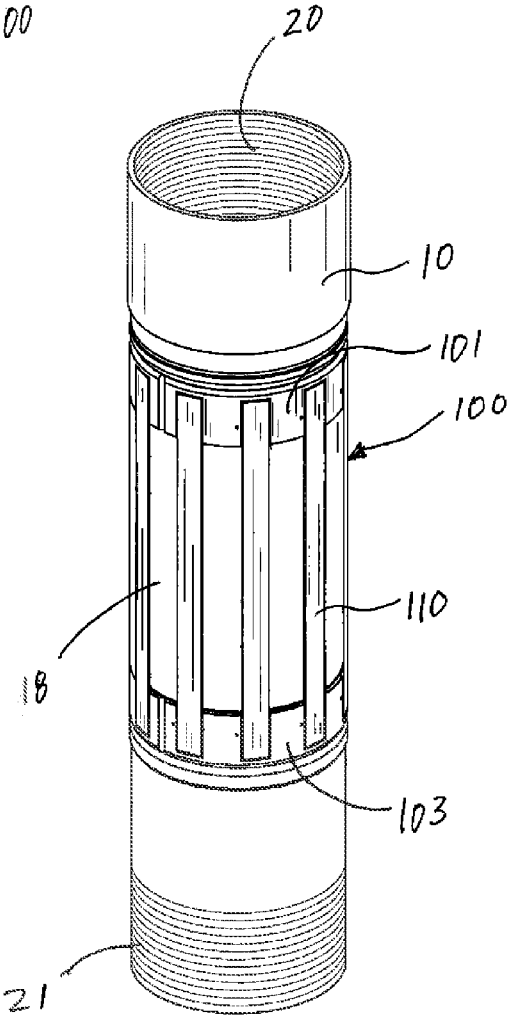
FIG. 3 depicts a perspective view of a centralizer assembly of the present invention with bow spring members collapsed.

FIG. 3 depicts a perspective view of a centralizer assembly 1 of the present invention with bow spring assembly 100 installed on central tubular body member 10 and bow spring members 110 collapsed. As depicted in FIG. 3, bow spring members 110 are compressed inward, forcing upper end band 101 (which moves axially within upper channel 12 of central body member 10) and lower end band 103 (which moves axially within lower channel 15) generally away from each other.

Figure 4:
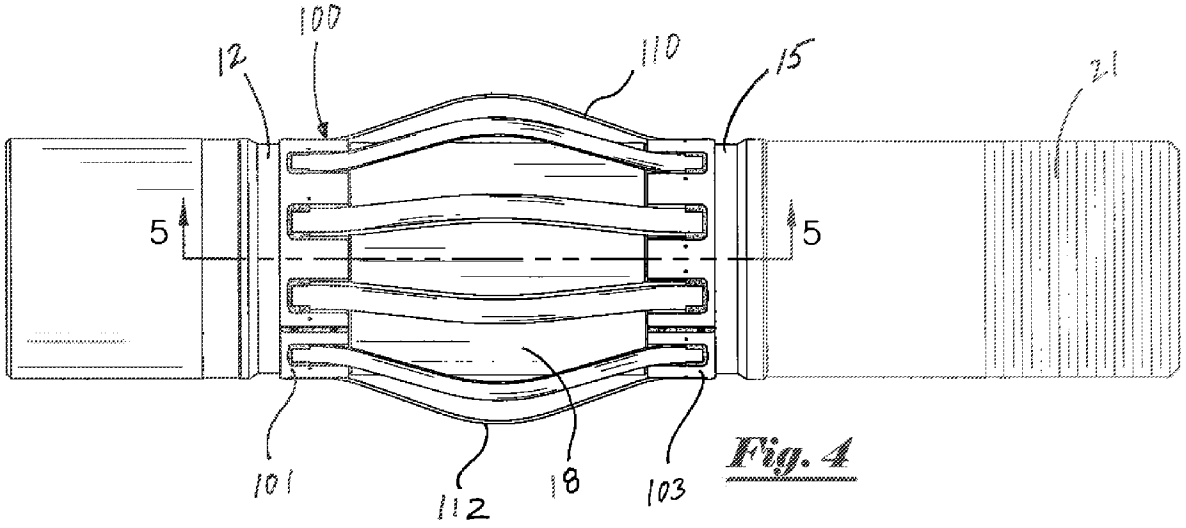
FIG. 4 depicts a side view of a centralizer assembly of the present invention with bow spring members extended.
Figure 5:
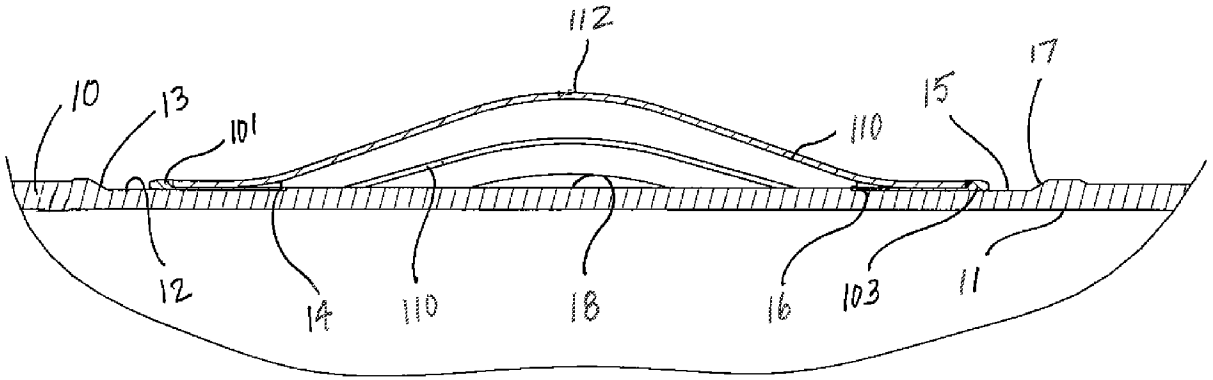
FIG. 5 depicts a side sectional view of a centralizer assembly of the present invention along line 5-5 of FIG. 4.

FIG. 4 depicts a side view of a centralizer assembly 1 of the present invention with bow spring members 110 extending radially outward, while FIG. 5 depicts a side sectional view of said centralizer assembly 1 along line 5-5 of FIG. 4. Referring to FIG. 5, bow spring members 110 extend outward, biasing upper end band 101 and lower end band 103 generally toward one another. As depicted in FIG. 2, FIG. 4 and FIG. 5, said bow spring members 110 extend radially outward from central body member 10, creating a larger outer diameter for centralizer assembly 1 at apex 112 of said bow spring members 110.

Referring to FIG. 5, in the preferred embodiment, upper shoulder surface 13 of upper channel 12 has a tapered or chamfered surface, while lower shoulder surface 14 of upper channel 12 is oriented substantially at a right angle. By contrast, lower shoulder surface 17 of lower channel 15 has a tapered or chamfered surface, while upper shoulder surface 16 of lower channel 15 is oriented substantially at a right angle.

Figure 6:
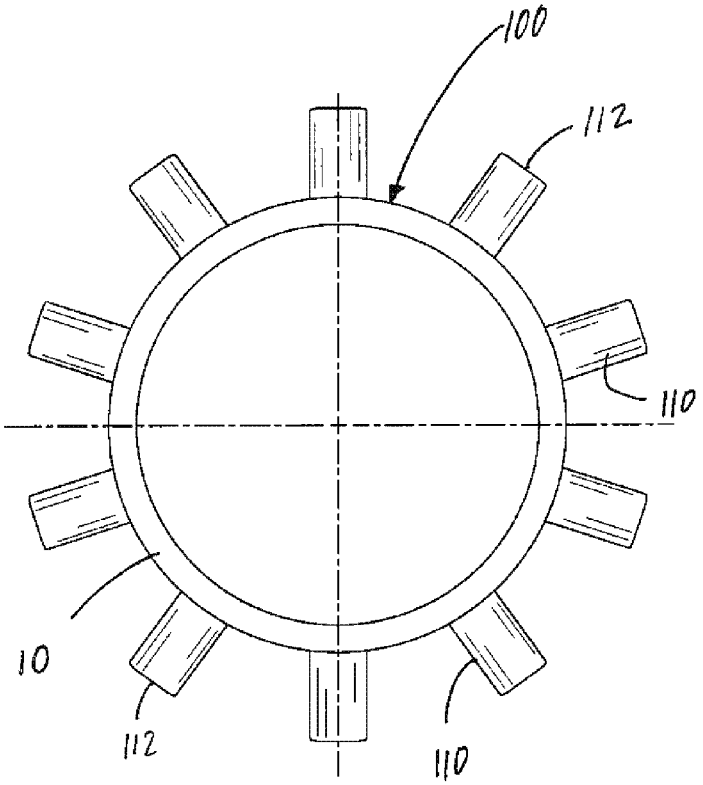
FIG. 6 depicts an end view of a centralizer bow spring assembly of the present invention with bow spring members extended.

FIG. 6 depicts an end view of a centralizer bow spring assembly 100 of the present invention with bow spring members 110 extended. As depicted in FIG. 6, bow spring members 110 extend radially outward beyond the outer diameter of body member 10, creating an overall larger outer diameter for centralizer assembly 1 at apex 112 of said bow spring members 110.

Figure 7:
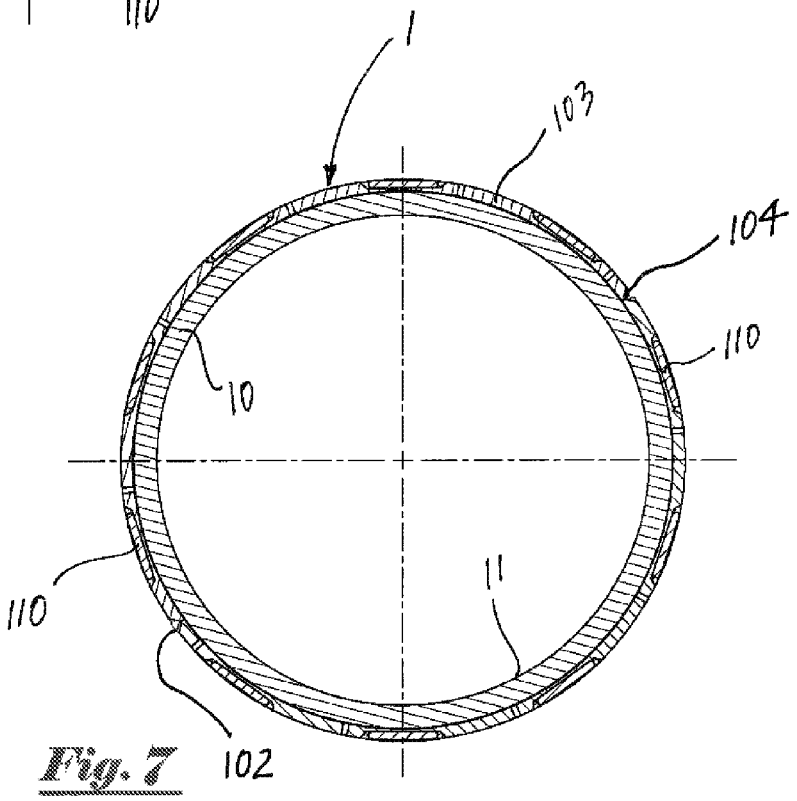
FIG. 7 depicts an end sectional view of a centralizer assembly of the present invention with bow spring members collapsed.

FIG. 7 depicts an end sectional view of a centralizer assembly 1 of the present invention with bow spring members 110 collapsed taken through end band 103. Lower end band 103 is disposed around central tubular body member 10 having central through bore 11. As depicted in FIG. 7, bow spring members 110 are compressed inward; in this position, said bow spring members 110 do not extend radially outward beyond the outer diameter of upper end band 101 or lower end band 103.

Figure 8:
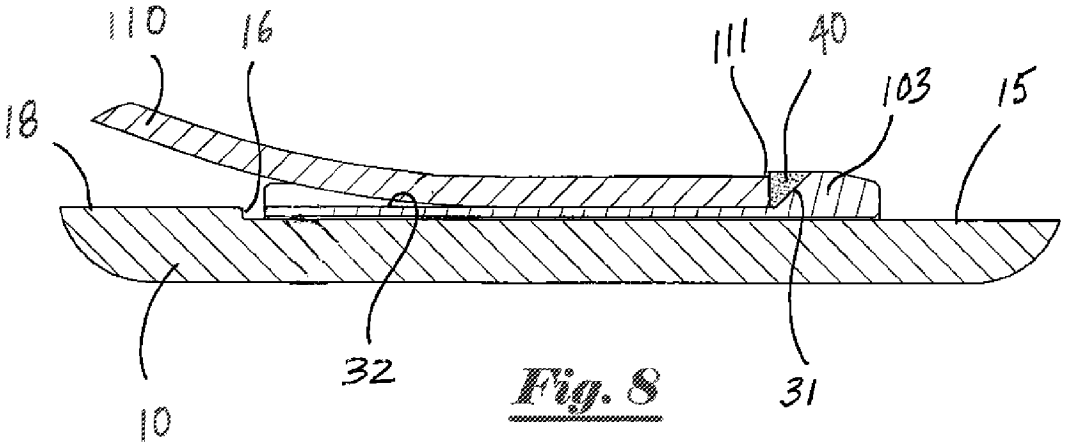
FIG. 8 depicts a side sectional view of a bow spring member and end band of a centralizer assembly of the present invention.

Said bow spring assembly 100 is beneficially rotatable relative to the outer surface of said central tubular body member 10 in either the expanded or collapsed configurations of FIG. 2 or FIG. 3; although, in most circumstances, bow spring assembly 100 remains stationary while central tubular body member 10 is rotated (typically, when an attached casing string is rotated while being installed in a well). FIG. 8 depicts a side sectional view of a bow-spring member 110 and end band 103 of a centralizer assembly of the present invention. End band 103 is disposed within lower channel 15 of central body member 10. End 111 of bow spring member 110 is received within notched recess 30 in end band 103 and welded in place to secure said bow spring member 110 to said end band 103.

As depicted in FIG. 8, a notched recess in end band 103 forms bow spring heel support 32. Said bow spring heel support 32 is disposed between bow spring member 110 and recessed channel 15 of central body member 10, and prevents such bow spring member 110 from contacting the outer surface 18 of said central body member 10 (or recessed channel 15) when said bow spring member 110 is compressed or collapsed inward, such as when said centralizer assembly passes through a restriction or "tight spot" within a well bore.

Still referring to FIG. 8, said bow spring heel support 32 effectively eliminates contact between inwardly-compressed bow spring members 110 and outer surface 18 (or recessed channel 15) of central tubular member 10 (particularly near the heels of said bow spring members 110), reducing any friction that would be created by said bow spring members 110 contacting outer surface 18. Reducing such friction results in reduced resistance as central tubular member 10 rotates within said collapsed bow spring members 110 and end bands 103 (as well as end band 101, not shown in FIG. 8). Further, said bow spring heel support 32 and end band 103 also provides a centralizer stop that, together with shoulder 16 of channel 15, prevents centralizer end band 103 from sliding off central tubular member 10 and allows centralizer assembly 1 to be "pulled" into a restriction no matter which direction pipe (and the centralizer assembly 1) is moving through a wellbore.

In many cases, casing strings or components thereof are constructed of alloys or other premium materials. Generally, it is not desirable for such alloys or other materials to contact conventional carbon steel elements, since contacting of such dissimilar materials can cause corrosion, pitting or other undesirable conditions. Accordingly, body member 10 of centralizer assembly 1 of the present invention, as well as end bands 101 and 103, can be constructed out of like material that is consistent with the remainder of a casing string being run (such as, for example, alloys, chrome or premium materials), while bow spring members 110 can be constructed of or contain dissimilar or different materials. Bow spring heel support 32 further ensures that bow springs 110 will not contact such body member 10, which may be constructed of an alloy, chrome or premium material. By way of illustration, but not limitation, end bands 101 and 103, as well as central tubular member 10, can be constructed of chrome (which is compatible with a casing string being installed), while bow spring members 110 can be constructed of spring steel. Heel support members 32 prevent dissimilar materials from contacting each other; spring steel in bow spring members 110 will not make physical contact with central tubular member 10.

Still referring to FIG. 8, chamfered edge surface 31 of recess 30, which receives end 111 of bow spring member 110, permits flush profile weld 40 (for example, using "MIG" or "TIG" welding, or other joining method) and provides for a stronger welded bond between said bow spring member 110 and end band 103. Such flush profile weld ensures that a weld bead does not extend beyond the outer surface of end band 103. Moreover, the quality of such weld 40 is also more easily inspected and verifiable than welds made on conventional bow spring centralizers.

Figure 10:
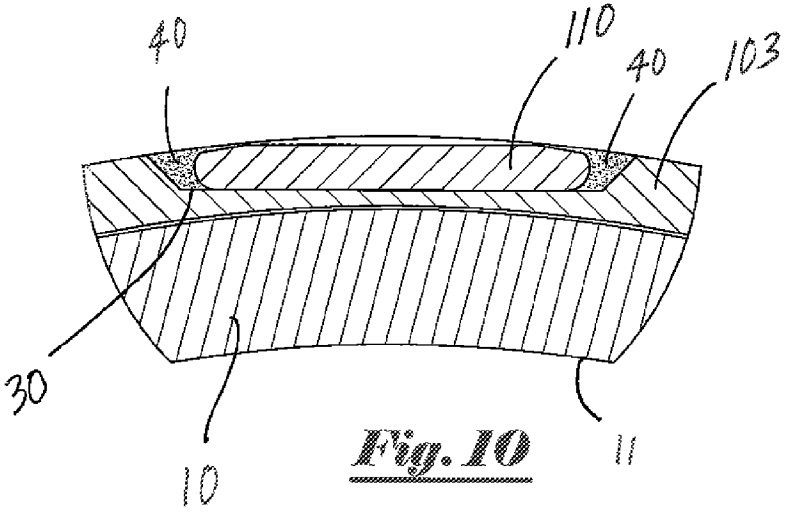
FIG. 10 depicts an end sectional view of a bow spring member and end band of a centralizer assembly of the present invention.

FIG. 10 depicts an end sectional view of a bow spring member 110 and end band 103 of a centralizer assembly of the present invention illustrating such flush profile. Bow spring member 110 is received within notched recess 30, while weld 40 does not extend radially outward beyond the outer surface of end band 103. Such flush profile is significant and highly desirable, because conventional methods of joining bow springs to an end band (such as, for example, bands and notches having abutting, squared-off edges) can result in weld beads forming on butt joints. With a conventional centralizer design, weld beads can protrude radially outward from the outer surface of an end band (such as end band 103), forming an unwanted protrusion that can damage wellheads or other equipment contacted by said centralizer assembly.

Figure 9:
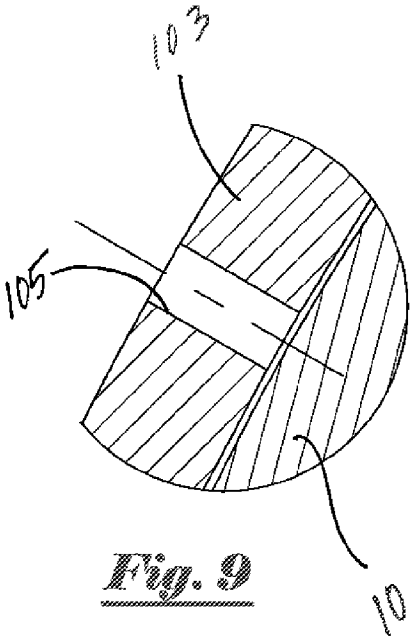
FIG. 9 depicts a side sectional view of a lubrication port of a centralizer assembly of the present invention.

Rotational interference between bow spring assembly 100 and central tubular body member 10 can be further minimized by employing friction reducing means to assist or improve rotation of said bow spring assembly 100 about said central tubular member 10. FIG. 9 depicts a side sectional view of an injection port 105 extending through end band 103. Grease or other lubricant can be injected through said injection port 105 to lubricate contact surfaces between said centralizer end band 103 and central body member 10. Additionally, corrosion inhibiting materials can be included with such lubricant or injected separately in order to protect bow spring assembly 100 and central body member 10 from corroding or oxidizing, particularly during extended periods of non-use or storage.

By way of illustration, but not limitation, such friction reducing means can also include bearings (including, but not necessarily limited to, fluid bearings, roller bearings, ball bearings or needle bearings). Said bearings can be mounted on the central tubular body member 10, centralizer end bands 101 or 103, upper recessed channel 12 or lower channel 15, or some combination thereof. Additionally, the areas where said centralizer end bands contact said central tubular member 10 (such as upper recessed channel 12 and/or lower recessed channel 15) can be constructed of, or coated with, friction reducing material including, without limitation, silicone or other material(s) having high lubricity or wear resistance characteristics.

Figure 11:
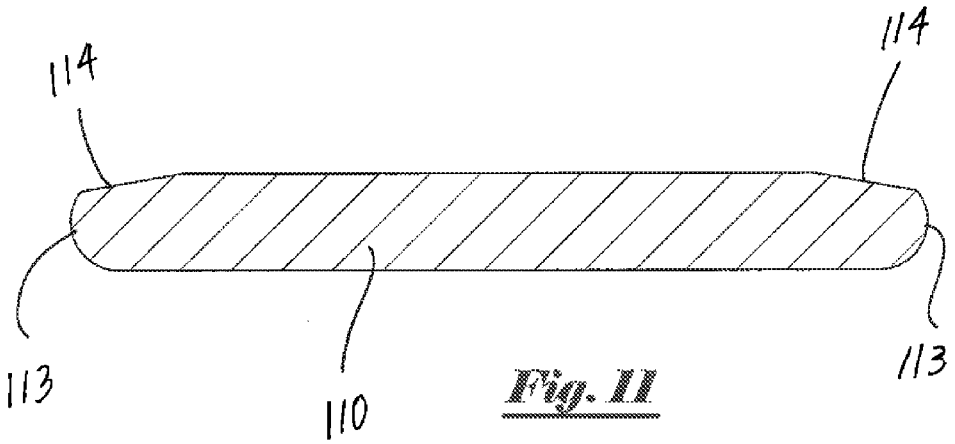
FIG. 11 depicts a sectional view of a bow spring member of the present invention having rounded ends and tapered outer surfaces.
Figure 12:
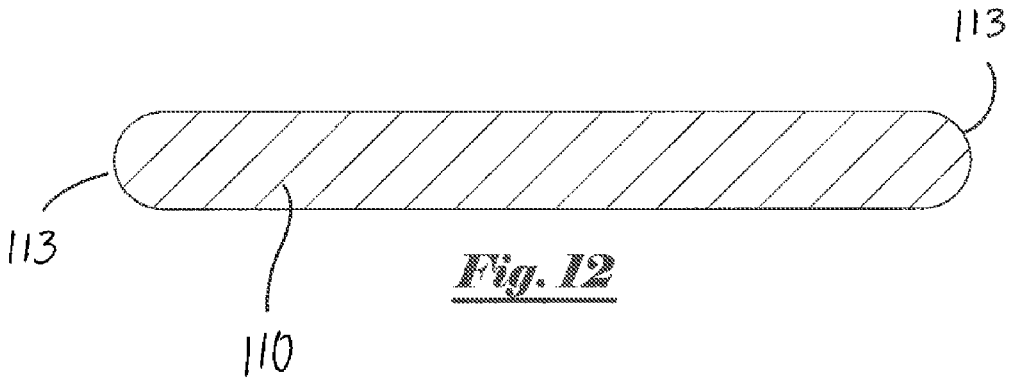
FIG. 12 depicts a sectional view of a bow spring member of the present invention having rounded ends but not tapered outer surfaces.

FIG. 11 depicts a sectional view of a bow spring member 110 of the present invention having a tapered outer surface, while FIG. 12 depicts a sectional view of a bow spring member 110 of the present invention not having a tapered outer surface. As depicted in FIGS. 11 and 12, outer edges 113 of bow spring member 110 can be rounded or curved. Such rounded outer edges 113 eliminate many sharp edges that can damage, gouge or mar polished surfaces of wellheads and other equipment. As depicted in FIG. 12, it can also be beneficial to include machined tapered surfaces 114 on said bow spring members 110 to allow for less radial protrusion and better welding characteristics. Such rounded edges permit the use of bow spring members 110 having thicker cross sectional areas, thereby increasing spring forces generated by said bow spring members 110.

In order to reduce and/or prevent damage to wellheads and, more particularly, polished surfaces of such wellheads, certain components of the present material can be wholly or partially constructed of synthetic or composite materials (that is, non-abrasive, low friction and/or non-metallic materials) that will not damage, gouge or mar polished surfaces of wellheads. In most cases, such components include bow spring members 110, because such bow spring members 110 extend radially outward the greatest distance relative to central body 10 of the centralizer, and would likely have the most contact with such polished surfaces.

Alternatively, certain components (including, without limitation, bow spring members 110) can be constructed with a metallic center for strength characteristics, with the edges or outer surfaces constructed of or coated with a plastic, composite, synthetic and/or other non-abrasive or low friction material having desired characteristics to prevent marring or scarring of a wellhead or other polished surfaces contacted by the centralizer of the present invention. Such non-abrasive or low friction material(s) can comprise elastomeric polyurethane, polytetrafluoroethylene (marketed under the Teflon® mark) and/or other materials exhibiting desired characteristics.

In a preferred embodiment, said non-abrasive or low friction material(s) can be beneficially sprayed or otherwise applied onto desired surface(s) of the centralizer or components thereof, similar to the way that bed liner materials (such as, for example, bed liners marketed under the trademark "Rhino Liners"®) are applied to truck beds. Further, in circumstances when a centralizer assembly 1 of the present invention is removed from a well, such non-abrasive or low friction material can be applied (or re-applied) to such centralizer assembly or portions thereof prior to running said centralizer back into said well.

Figure 13:
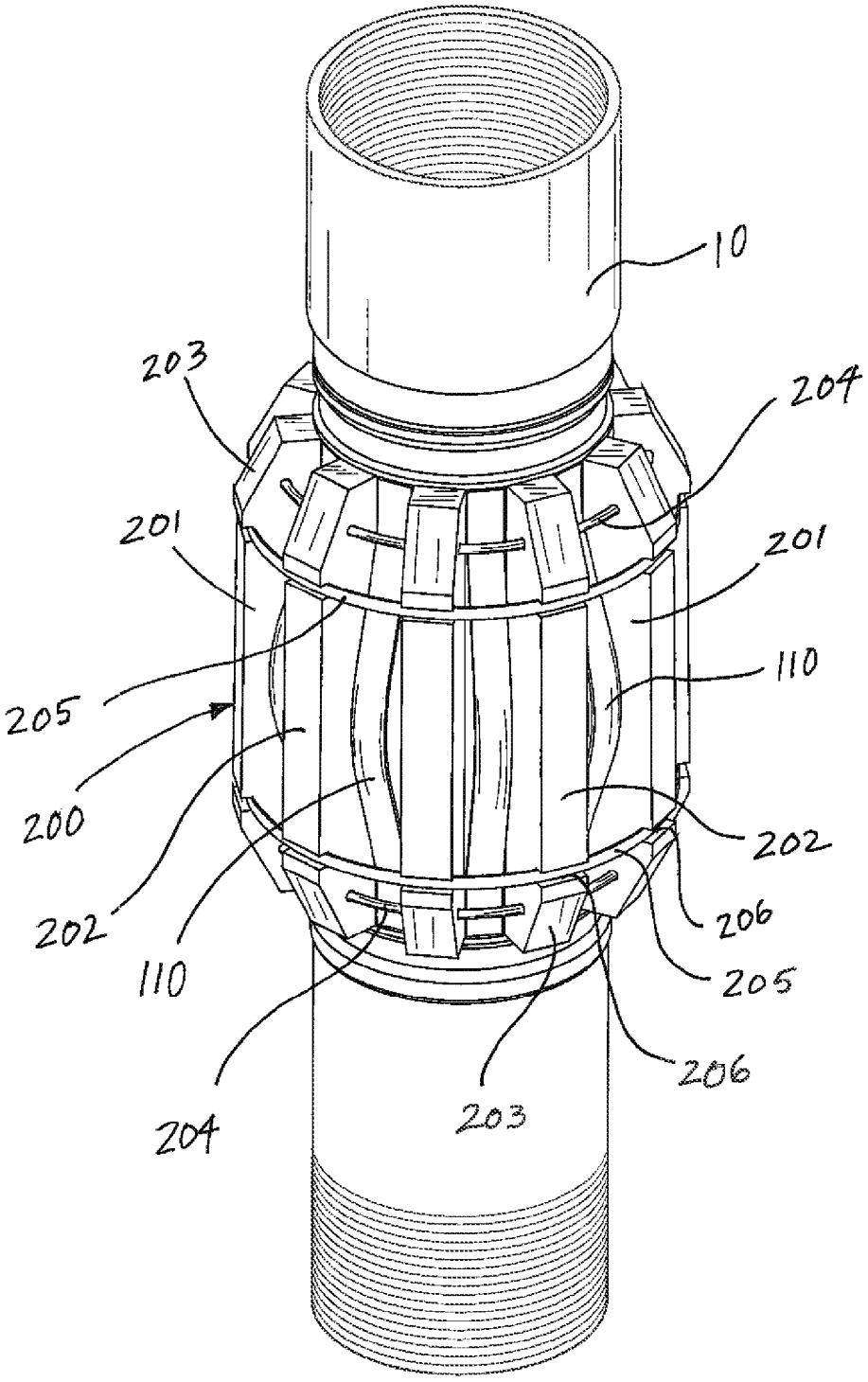
FIG. 13 depicts a perspective view of a centralizer assembly of the present invention with a bolster frame assembly installed.

FIG. 13 depicts a perspective view of a centralizer assembly 1 of the present invention with a bolster assembly 200 installed. Said bolster assembly 200 of the present invention can be used to protect the centralizer assembly of present invention, and particularly bow spring members 110 thereof, from damage during transportation and/or handling. In the preferred embodiment, the protective bolster assembly 200 of the present invention is inexpensive, reusable and easy to install and remove.

As depicted in FIG. 13, bolster assembly 200 comprises a plurality of rigid members 201. Although said rigid members 201 can have a variety of different shapes or configurations, as depicted in FIG. 13 said rigid members 201 have substantially flat outer surfaces 202 with tapered edge surfaces 203. Said rigid members 201 can be joined with an elastic band member 204, and can be installed within spaces or gaps formed between bow spring members 110. Cable ties 205 can be installed within aligned recesses 206 to secure said rigid members 201 in place.

Figure 14:
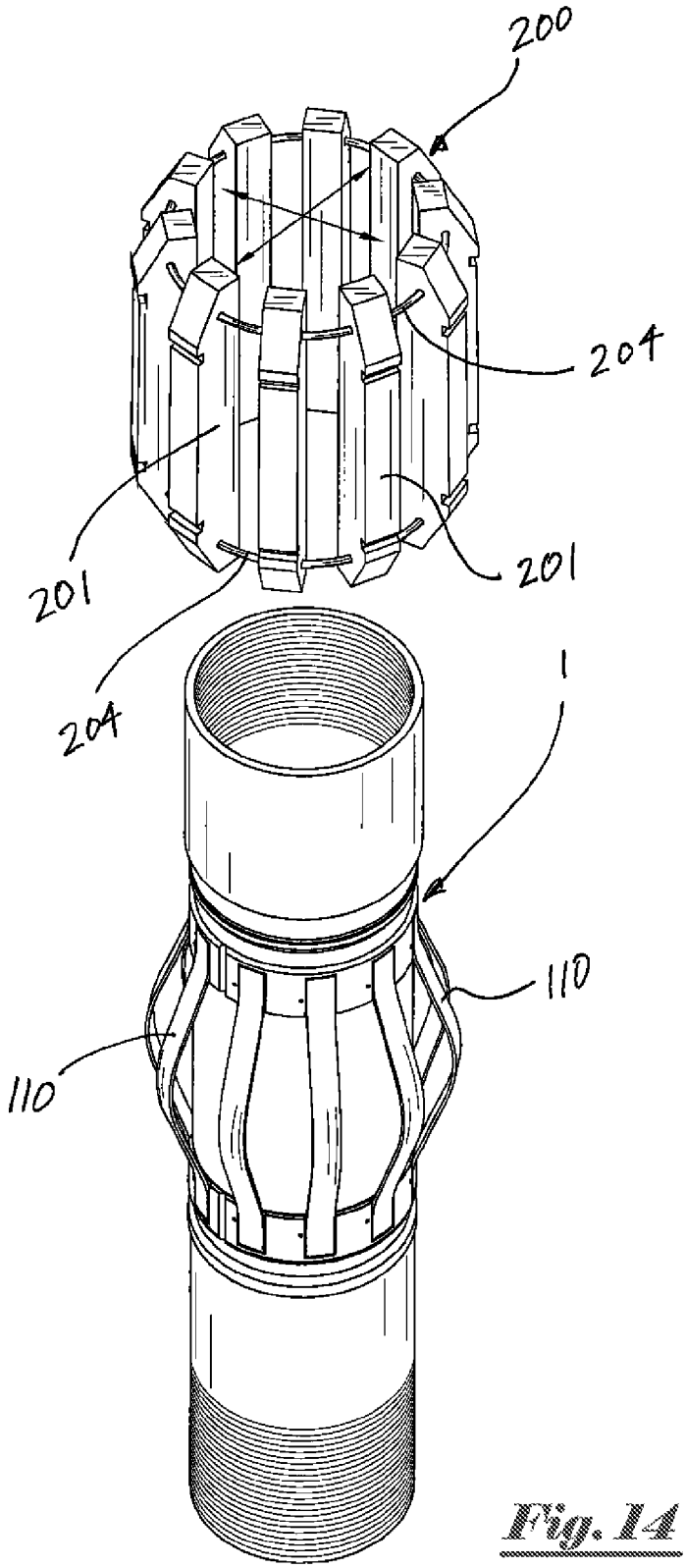
FIG. 14 depicts an exploded perspective view of a centralizer assembly and bolster frame assembly of the present invention.

FIG. 14 depicts an exploded perspective view of a centralizer assembly 1 and bolster assembly 200 of the present invention. During installation, rigid members 201 of bolster assembly 200 can be aligned with centralizer assembly 1. Said rigid members 201 can be spread apart to fit over said centralizer assembly 1 and between bow spring members 110; elastic band members 204 permit said rigid members 201 to spread apart radially outward so that said rigid members can fit over said centralizer assembly 1.

Figure 15:
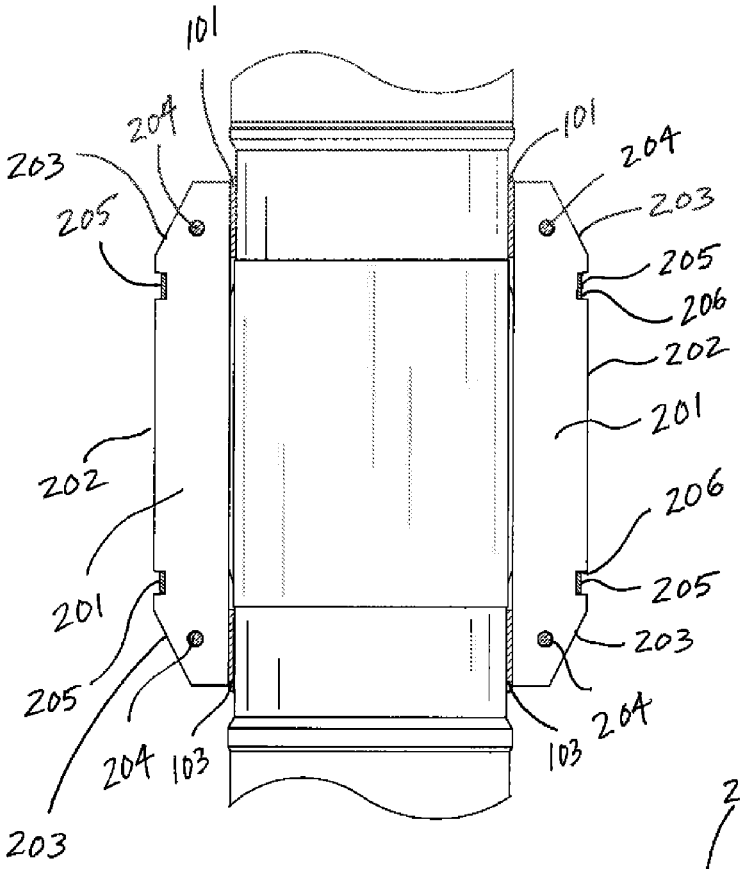
FIG. 15 depicts a side sectional view of a centralizer assembly of the present invention with a bolster frame assembly installed.

FIG. 15 depicts a side sectional view of a centralizer assembly 1 of the present invention with a bolster assembly 200 installed. Bolster assembly 200 comprises a plurality of rigid members 201. Although said rigid members 201 can have a variety of different shapes or configurations, as depicted in FIG. 15 said rigid members 201 have substantially flat outer surfaces 202 with tapered edge surfaces 203. Said rigid members 201 can be joined with an elastic band member 204, and can be installed within spaces or gaps formed between bow spring members of centralizer assembly 1. Cable ties or other securing method (for example, inelastic metal or synthetic banding), such as cable tie 205 can be installed within aligned recesses 206 to secure said rigid members 201 in place.

Figure 16:
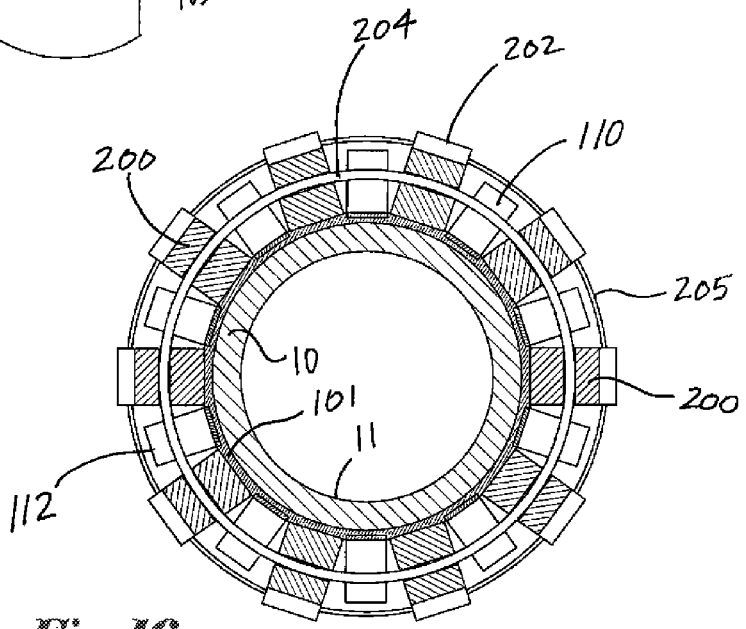
FIG. 16 depicts an end sectional view of a centralizer assembly of the present invention with a bolster frame assembly installed.

FIG. 16 depicts an end sectional view of a centralizer assembly 1 of the present invention with a bolster assembly 200 installed. Bolster assembly 200 comprises a plurality of rigid members 201 that are installed within spaces or gaps formed between bow spring members 110 of centralizer assembly 1. Elastic band member 204 joins said rigid members, while cable ties 205 secure said rigid members 201 in place. Outer surfaces 202 of said rigid members 201 extend radially outward further than bow springs 110. In the event of unexpected or undesirable contact (such as collisions, dragging or improper storage), rigid members 201 encircle and protect bow spring members 110.

Rigid members 201 of bolster assembly 200 of the present invention can be beneficially constructed from composite material(s) and/or coated with moisture-resistant material(s) to resist moisture absorption and prevent corrosion when in contact with metal components of a bow spring assembly 100 or central tubular member 10. Additionally, it is to be observed that bolster assembly 200 of the present invention can be beneficially collapsed for convenient storage and shipping of such bolster assembly 200 when not in use or installed on a centralizer or other tool.

In an alternative embodiment, the bolster assembly of the present invention has rigid end pieces which can be molded or otherwise fabricated. This embodiment of the bolster assembly of the present invention, which can be utilized instead of conventional wooded crates or other similar devices commonly used for during the transportation and handling of such equipment, eliminates the need for securing bolster members in such crates.

Figure 17:
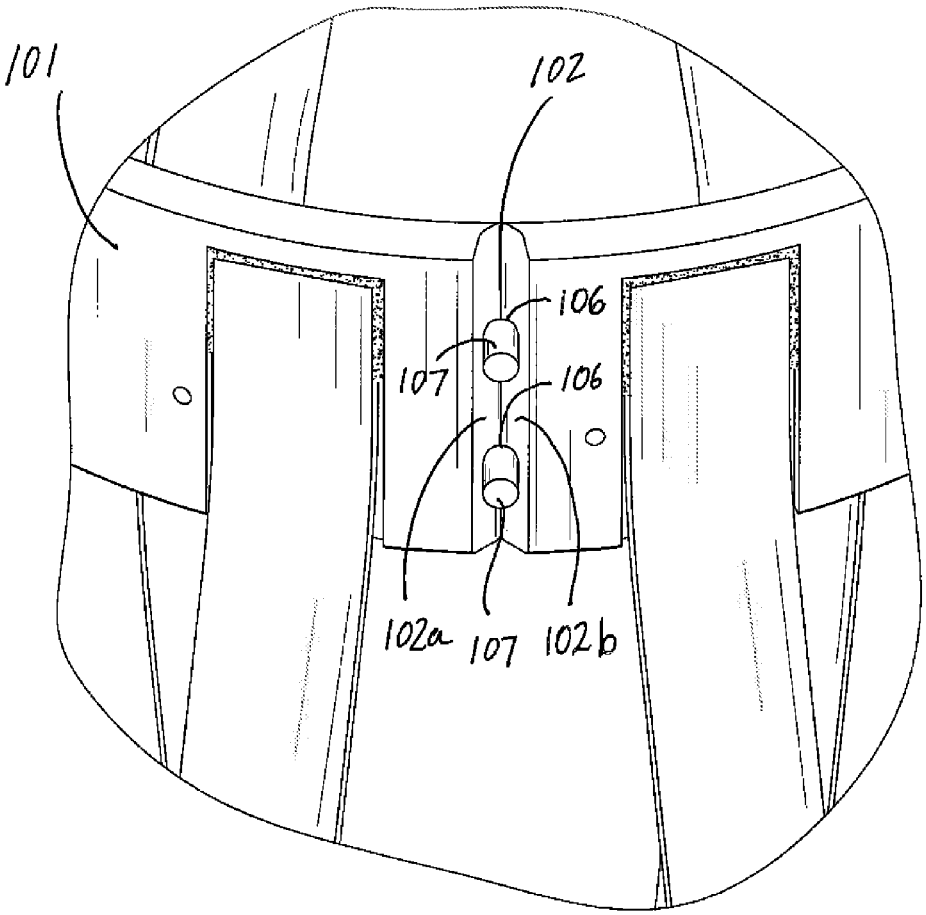
FIG. 17 depicts a perspective view of an embodiment of a centralizer end band of the present invention.

FIG. 17 depicts a perspective view of an embodiment of a centralizer end band 101 of the present invention. In a preferred method of manufacture of centralizer assembly 1 of the present invention, end bands 101 and 103 are machined for precise tolerances. Said end bands 101 and 103 each form sleeves having a substantially cylindrical shape.

Referring to FIG. 7, beveled grooves 102 and 104 are cut or otherwise formed in each of said cylindrical sleeve-like end bands (end band 103 is depicted in FIG. 7, but end band 101 can also have said beveled grooves); said beveled grooves are phased approximately 180 degrees apart from each other around the circumference of each end band, and extend substantially the entire length of each such end band.

FIG. 17 depicts a side perspective view of beveled groove 102 in end band 101 of the present invention. Said beveled groove has chamfered edges 102*a* and 102*b*, and extends substantially the entire length of end band 101. Although not pictured in FIG. 17, beveled groove 104 is similarly formed within end band 101, and is phased approximately 180 degrees away from beveled groove 102 (that is, on the opposite side of end band 101 from beveled groove 102). In the preferred embodiment, alignment bores 106 can be formed within beveled groove 102, and alignment pegs 107 can be temporarily installed within said alignment bores to further assure alignment.

Figure 18:
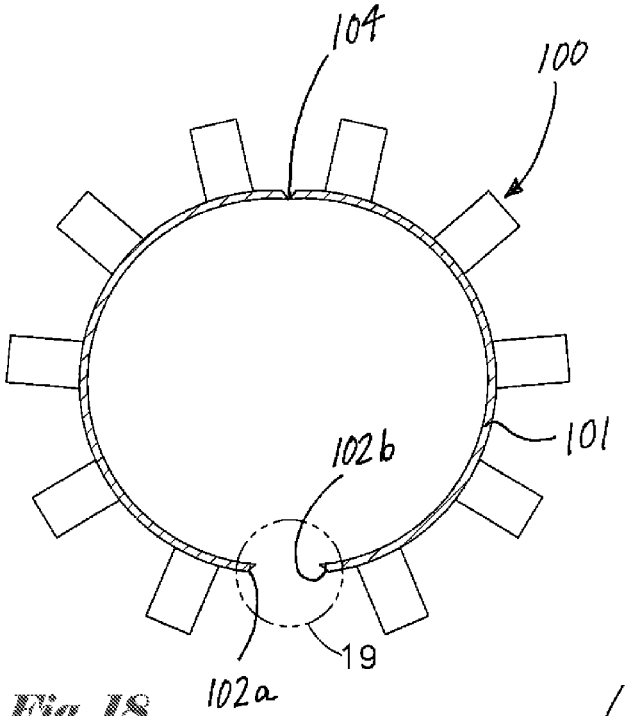
FIG. 18 depicts an end view of a centralizer bow spring assembly of the present invention in a partially split configuration.
Figure 19:
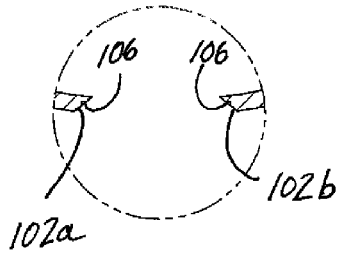
FIG. 19 depicts a detailed view of the highlighted area depicted in FIG. 18.

FIG. 18 depicts an end view of a centralizer bow spring assembly 100 of the present invention with end band 101 in a partially split configuration. Beveled groove 102 can be cut or split at its thinnest point allowing end band 101 to be split and "butterfly" spread apart. Beveled groove 104 serves as a hinge to permit such spreading of end band 101. FIG. 19 depicts a detailed view of the highlighted area depicted in FIG. 18, wherein beveled groove 102 having transverse alignment bore 106 is split, separating chamfered surfaces 102*a* and 102*b*. After being radially spread apart, said sleeve-like end band 101 can be installed around the outer surface of a central tubular body member (such as tubular body member 10 depicted in FIG. 7), and rejoined.

Figure 20:
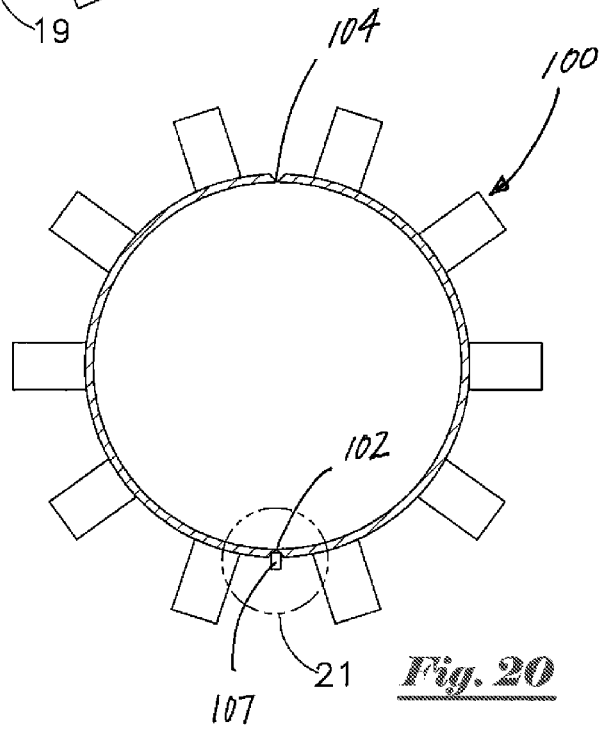
FIG. 20 depicts an end view of a centralizer bow spring assembly of the present invention in a joined configuration.
Figure 21:
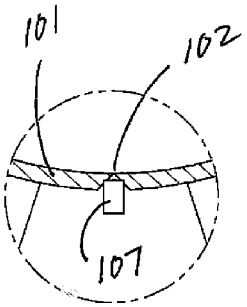
FIG. 21 depicts a detailed view of the highlighted area depicted in FIG. 20.

Thereafter, sleeve-like end band 101 (as well as end band 103) can be closed about the outer surface of said central tubular member, with beveled groove 104 again serving as a hinge to permit such closing of end band 101. FIG. 20 depicts an end view of a centralizer bow spring assembly 100 of the present invention with beveled groove 102 in a re-joined configuration. FIG. 21 depicts a detailed view of the highlighted area depicted in FIG. 20. Alignment bores 106 can be matched to visually confirm proper alignment of said rejoined groove 102 of end band 101; optional alignment pegs 107 can be temporarily installed within said alignment bores 106 to further confirm such alignment, with any required positioning adjustments being made. Once alignment is properly confirmed, alignment pegs 107 can be removed and beveled grooves 102 and 104 can be welded in order to secure said sleeve-like end band 101 about the outer surface of a central tubular body member.

It is to be observed that a similar process can be followed with sleeve-like end band 103. When completed, end bands 101 and 103 are oriented substantially parallel to each other, and are rotatably disposed about the outer surface of a central tubular body member.

In certain circumstances, particularly for centralizers having relatively small diameters, it may be beneficial to split at least one centralizer band by separating said band into two pieces by cutting through both of said beveled grooves. Thereafter, said sleeve-like end band can be completely separated, positioned about the outer surface of a central tubular member, and rejoined to form a cylindrical member. Alignment bores can be matched to visually confirm proper alignment of said closed end bands; optional alignment pegs can be temporarily installed within said alignment bores to further confirm such alignment, with any required positioning adjustments being made. Once properly positioned, said beveled grooves can be welded in order to reattach said band halves and secure said reattached sleeve-like end band about the outer surface of a central tubular body member.

When conventional end bands are installed on a tubular body member, existing manufacturing means (typically rolled steel) frequently result in said bands becoming "egg-shaped", out-of-round, or otherwise deformed. The manufacturing process described herein results in sleeve-like end bands 101 and 103 remaining substantially cylindrical in shape, which results in precise tolerances and superior rotational performance of the centralizer assembly of the present invention.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A well centralizer comprising:

a) a tubular member having a central through bore, an outer surface, and first and second circumferential channels disposed in said outer surface;

b) a first band member rotatably disposed in said first circumferential channel;

c) a second band member rotatably disposed in said second circumferential channel;

d) a plurality of bow spring members, each having a first end and a second end, wherein said first end is connected to said first band member and said second end is connected to said second band member; and e) a support member disposed between at least one bow spring member and said first band member.

2. The well centralizer of claim 1, further comprising a support member disposed between at least one bow spring member and said second band member.

3. The well centralizer of claim 2, wherein said bow spring members do not contact said outer surface of said tubular member when said bow spring members are fully elongated.

4. The well centralizer of claim 1, wherein said first and second band members are manufactured using a machining process.

5. The well centralizer of claim 1, further comprising at least one lubrication port extending through said first band member or said second band member.

6. The well centralizer of claim 5, further comprises at least one bearing adapted for reducing friction between said tubular member, and said first and second band members.

7. The well centralizer of claim 1, wherein said first end of each bow spring members is flush mounted to said first band member and said second end of each bow spring member is flush mounted to said second band member, and no welds extend beyond the outer surfaces of said first or second band members.

8. The well centralizer of claim 1, further comprising a recessed notch in said first band member, adapted to receive a first end of a bow spring member, wherein said recessed notch has at least one chamfered edge and said first end of said bow spring member is welded to said first band member.

9. The well centralizer of claim 8, further comprising a recessed notch in said second band member, adapted to receive a second end of a bow spring member, wherein said recessed notch has at least one chamfered edge and said second end of said bow spring member is welded to said second band member.

10. The well centralizer of claim 1, wherein said well centralizer assembly at least partially comprises a non-abrasive or friction reducing material.

11. The well centralizer of claim 10, wherein said bow spring members comprise a non-metallic material.

12. The well centralizer of claim 10, wherein said bow spring members comprise a metallic body coated with a non-abrasive material.

13. The well centralizer of claim 12, wherein said non-abrasive material comprises elastomeric polyurethane or polytetrafluoroethylene.

14. The well centralizer of claim 1, further comprising a bolster assembly comprising:

a) a plurality of rigid body members disposed between said bow spring members, wherein said rigid members extend radially outward from said tubular member beyond said bow spring members; and b) at least one elastic band extending through said rigid members, said elastic band biasing said rigid members toward said tubular member.

15. The well centralizer of claim 14, further comprising an inelastic band disposed around said rigid body members.

16. The well centralizer of claim 1, wherein said bow spring members have at least one rounded lateral edge.

* * * * *